US010085491B2

(12) United States Patent
Howard

(10) Patent No.: US 10,085,491 B2
(45) Date of Patent: Oct. 2, 2018

(54) UNDERPANTS WITH ENHANCED ACCESS FLY

(71) Applicant: Wanda L. Howard, Jacksonville, FL (US)

(72) Inventor: Henry L Howard, Jacksonville, FL (US)

( * ) Notice: Subject to any disclaimer, the term of this patent is extended or adjusted under 35 U.S.C. 154(b) by 0 days.

(21) Appl. No.: 14/827,577

(22) Filed: Aug. 17, 2015

(65) Prior Publication Data

US 2016/0066622 A1 Mar. 10, 2016

Related U.S. Application Data

(60) Provisional application No. 62/070,277, filed on Aug. 21, 2014.

(51) Int. Cl.
*A41B 9/02* (2006.01)

(52) U.S. Cl.
CPC ..... *A41B 9/026* (2013.01)

(58) Field of Classification Search
CPC .. A41B 9/02; A41B 9/026; A41B 9/00; A41B 9/001; A41B 9/002; A41B 9/004; A41B 9/005; A41B 9/007; A41B 9/008; A41B 9/023; A41B 9/14; A41B 9/16
USPC ..... 2/405
See application file for complete search history.

(56) References Cited

U.S. PATENT DOCUMENTS 2,019,140 A * 10/1935 Kneibler ..... A41B 9/02 2/403
2,808,592 A * 10/1957 Schwarz ..... A41B 9/02 2/403
3,207,155 A * 9/1965 Cullen ..... A41B 9/02 2/403
6,412,119 B1 * 7/2002 Robles ..... A41B 9/007 2/400
6,901,607 B1 * 6/2005 Elwell ..... A41B 9/026 2/400
8,782,817 B2 * 7/2014 Gu ..... A41B 9/023 2/405
8,800,064 B2 * 8/2014 Delija ..... A41B 9/023 2/403
2009/0320184 A1 * 12/2009 Schaefer ..... A41B 9/02 2/405

FOREIGN PATENT DOCUMENTS

JP 4879333 B2 * 2/2012 ..... A41B 9/026

* cited by examiner

*Primary Examiner* — Joshua E Rodden

(57) ABSTRACT

In view of the foregoing, it is an object of the present invention to provide underpants with an enhanced access fly and related methods of use and making; according to an embodiment of the present invention, underpants include a fabric shell with the first and second fly borders which define a fly opening therein; an access strap is attached proximate to the first fly border such that the fly opening is enlarged by movement of the strap; according to an aspect of the present invention, the fly opening oriented is generally vertical direction and the strap extends generally horizontally away for the first fly border.

1 Claim, 2 Drawing Sheets

UNDERPANTS WITH ENHANCED ACCESS FLY

FIELD OF THE INVENTION

The present invention relates to male underpants having a fly to facilitate urination.

BACKGROUND OF THE INVENTION

Male underpants are frequently manufactured to incorporate a fly through which the penis can be withdrawn in order to allow urination without lowering of the underpants. Very frequently, the outer garments, such as shorts or pants, also have a fly which is generally aligned with that of the underpants and must be opened first to allow access. While the use of the fly (or files) is generally considered more convenient (and socially acceptable) for urination than simply dropping one's trousers and underpants, difficulties still exist.

For instance, body movement will often cause the underpants to twist or otherwise move relative to the outer garments such that their respective flies are no longer aligned and/or that the fly of the underpants is generally not where one would expect to find it. An undesirable delay can be incurred as a result of the need to locate the opening flap of the underpants fly in order to gain the necessary access. This delay is particularly problematic in the case of persons with arthritis, hand or wrist injuries, or other conditions affecting manual dexterity, as well in the case of individuals with bladder control problems.

SUMMARY OF THE INVENTION

In view of the foregoing, it is an object of the present invention to provide underpants with an enhanced access fly and related methods of use and making. According to an embodiment of the present invention, underpants include a fabric shell with first and second fly borders which define a fly opening therein. An access strap is attached proximate to the first fly border such that the fly opening is enlarged by movement of the strap. According to an aspect of the present invention, the fly opening is oriented is generally vertical direction and the strap extends generally horizontally away from the first fly border.

These and other object and aspects of the present invention will be better appreciated in view of the drawings and following detailed description of preferred embodiments.

DETAILED DESCRIPTION OF PREFERRED EMBODIMENTS

Figure 1:
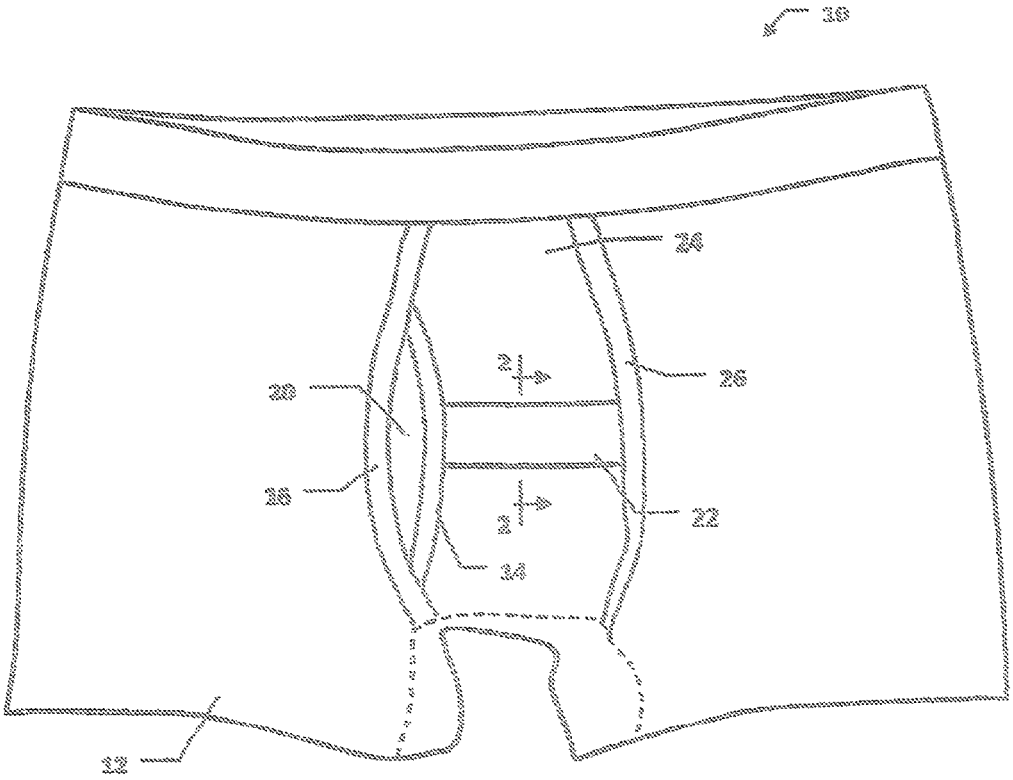
FIG. 1 is a front view of underpants with an enhanced access fly, according to an embodiment of the present invention.

Referring to FIG. 1, according to an embodiment of the present invention, underpants 10 include a fabric shell 12 composed of one or more pieces of fabric. As used herein "fabric" generically refers to the construction material(s) of the underpants, and could include woven end/or unwoven materials, as well as natural and/or artificial materials. The fabric 12 has first and second fly borders 14, 16 defining a fly opening 20 therebetween. An access strap 22 is attached to the fabric shell 12 proximate the fly opening 20 such that movement of the strap 22 is effective to enlarge the fly opening 20. Access through the opening 20 is thereby facilitated.

In most underpants with a fly, the fly opening is as depicted in FIG. 1—oriented in a generally vertical direction, such that fly borders 14, 16 must be pulled apart generally horizontally to enlarge the fly opening 20. The preferred access strap 22 orientation in this case is extending generally horizontally away from the opening 20 and fly borders 14, 16.

Advantageously, one end of the strap 22 is connected to the shell 12 at the first fly border 14. In many underpants, as in FIG. 1, the fabric shell 12 includes a distinct front panel 24 extending between the first fly border 14 and a front panel seam 26. In such underpants, the other end of the strap 22 is connected at the front panel seam 26. Thus, the strap 22 can be easily attached to the fabric shell 12 at the same time the first fly border 14 and the front panel seam 26 are sewn, and no additional sewing would be necessary to incorporate the access strap 22.

Figure 2A:
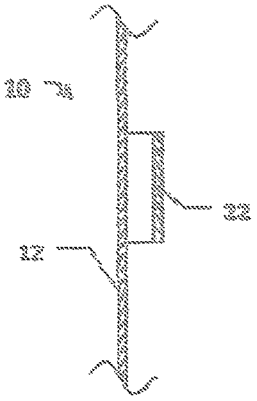
FIG. 2A is a sectional view taken along line 2-2 of FIG. 1.
Figure 2B:
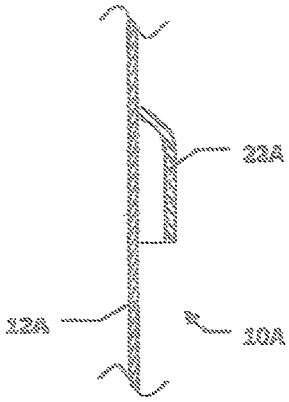
FIG. 2B is an alternate sectional view taken along line 2-2, according to another embodiment of the present invention.

Referring to FIG. 2A, it will be appreciated that the strap 22 is not connected to the shell 12 at the top or bottom edges thereof (directional terms being used with reference to orientation shown in the Figures). Alternately, referring to FIG. 2B, underpants 10A could include a strap 22A which attaches to fabric shell 12A along a top edge thereof, such that the strap 22A forms downwardly opening pocket. While a downwardly opening pocket is believed preferable from a convenience standpoint, a strap could alternately be attached along the bottom edge to form an upwardly opening pocket.

Additionally, access strap dimensions could be varied, as desired. For example a length (i.e., the horizontal dimension in FIGS. 1, 3, and 4) sufficient to extend at least completely across the front panel 24 is preferable on underpants so equipped. A width (i.e., the vertical dimension in the Figures) of approximately one inch to approximately 3 inches is preferred. It will be appreciated that further modifications could also be made without departing from the scope of the invention.

Figure 3:
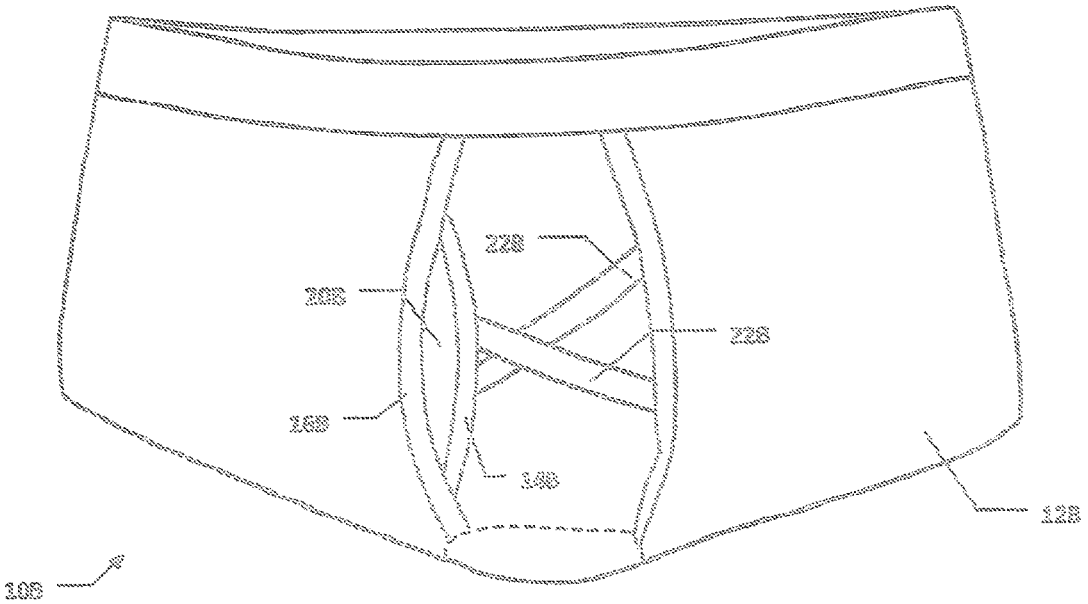
FIG. 3 is a front view of underpants with an enhanced access fly, according to a further embodiment of the present invention.

For example, referring to FIG. 3, underpants 10B include a plurality of straps 22B attached to the fabric shell 12B extending away from the fly opening 20B and borders 14B, 16B. The multiple straps 22B can be intersecting (as shown) or parallel, potentially increasing locatability by the wearer. Also, as will be appreciated from FIGS. 1 and 3, the present invention is readily applicable to different underwear styles—including briefs (FIG. 3) and boxer briefs (FIG. 1). While particularly advantageous with these underwear types, in which overlapping panels extend from the fly borders—thus making access somewhat more difficult—the present invention could also readily be applied to other underwear types with flies, such as conventional boxer shorts.

Figure 4:
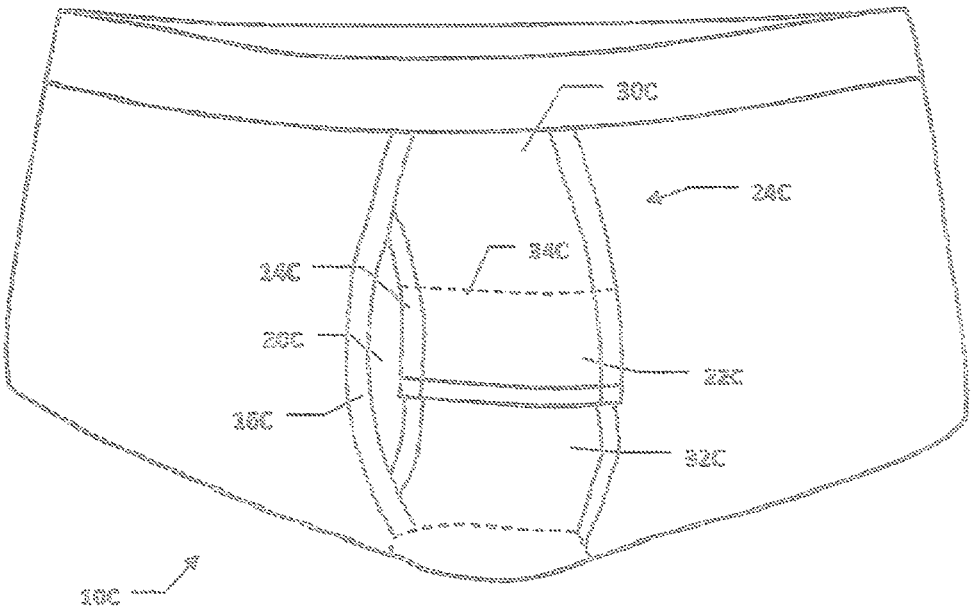
FIG. 4 is a front view of underpants with an enhanced access fly, according to an additional embodiment of the present invention.

Referring to FIG. 4, in another example, where the underpants 10C include a distinct front panel 24C, the strap 22C can be formed as an overlapping junction between upper and lower front panel parts 30C, 32C. With the upper front panel part 30C located in front (as shown), the strap 22C forms a downwardly opening pocket. The lower front panel part 32C need not completely extend under the upper part 30C, terminating as shown along the line 34C. If it is desired to close the top of the pocket formed by strap 22C, the parts 30C, 32C can be stitched or otherwise connected along the line 34C.

The foregoing embodiments are provide for illustrative and exemplary purposes; the present invention is not necessarily limited thereto. Instead, those skilled in the art will appreciate that these and other modifications, as well as adaptations to particular circumstances, will fall within the scope of the invention as herein shown and described.

The invention claimed is:

1. An underpant for a man, comprising:

a fabric shell formed from one or more pieces of fabric;

the fabric shell having first and second fly borders extending vertically, and parallel to one another and defining a fly opening therebetween;

a front panel seam extending vertically, and extending parallel to each of the first and second fly borders, a front panel located between the first fly border and the front panel seam;

multiple straps extending substantially horizontally between the first fly border and the front panel seam across a width of the front panel, such that movement of the straps is effective to enlarge the fly opening, with the multiple straps being in the form of two straps intersecting one another, and wherein the each of the straps is only connected to the first fly border and the front seam panel at ends of the straps thereof.

* * * * *